United States Patent [19]

Held

[11] Patent Number: 4,615,758

[45] Date of Patent: Oct. 7, 1986

[54] CONTINUOUSLY OPERATING PRESS FOR PRESSING AN ADVANCING WEB OF MATERIAL

[76] Inventor: Kurt Held, Alte Strasse 1, 7218 Trossingen 2, Fed. Rep. of Germany

[21] Appl. No.: 656,524

[22] Filed: Oct. 1, 1984

[30] Foreign Application Priority Data

Oct. 19, 1983 [DE] Fed. Rep. of Germany ..... 3337913

[51] Int. Cl.[4] ..... B30B 5/06; B30B 15/34

[52] U.S. Cl. ..... 156/359; 100/33 RP; 100/154; 156/360; 156/381; 156/555; 156/583.5; 425/141; 425/371

[58] Field of Search ..... 156/583.5, 555, 582, 156/359, 360, 381; 100/93 RP, 154; 425/141, 371

[56] References Cited

U.S. PATENT DOCUMENTS

| | | | |
|---|---|---|---|
| 2,071,999 | 2/1937 | Dike | 100/93 RP |
| 2,975,470 | 3/1961 | Snelson et al. | 100/93 RP |
| 4,360,189 | 11/1982 | Duncan et al. | 100/93 RP |
| 4,417,865 | 11/1983 | Pfeiffer | 425/371 |

FOREIGN PATENT DOCUMENTS 1939784 3/1971 Fed. Rep. of Germany .

*Primary Examiner*—Michael Wityshyn
*Attorney, Agent, or Firm*—Leydig, Voit & Mayer, Ltd.

[57] ABSTRACT

The invention relates to a continuously operating press for pressing an advancing web of material, comprising a rigid press frame, an upper and a lower endless press belt, each guided over a pair of deflection rollers mounted for rotation on the press frame, comprising a heating device to heat at least one deflection roller of each pair, comprising a reaction zone located between the upper and lower press belt strands facing each other for pressing the advancing web of material with the simultaneous application of heat, and comprising pressure plates with a heating device at the rear sides of the press belt strands remote from the reaction zone for exerting a pressure on these rear sides and, consequently, on the web of material. In order to attain dimensional accuracy of the laminates exiting from the press, provision is made for the press frame or at least parts of it to be additionally heated by a further heating device and for thermal shield caps which may be moved out of the way to be arranged on the press frame.

34 Claims, 5 Drawing Figures

CONTINUOUSLY OPERATING PRESS FOR PRESSING AN ADVANCING WEB OF MATERIAL

The invention relates to a continuously operating press for pressing an advancing web of material, comprising a rigid press frame, an upper and a lower endless press belt, each guided over a pair of deflection rollers mounted for rotation on the press frame, comprising a heating device to heat at least one deflection roller of each pair, comprising a reaction zone located between the upper and lower press belt strands facing each other for pressing the advancing web of material with the simultaneous application of heat, and comprising pressure plates with a heating device at the rear sides of the press belt strands remote from the reaction zone for exerting a pressure on these rear sides and, consequently, on the web of material.

In known apparatus of this kind, the finished product, i.e., a web of material pressed under the effect of heat, for example, in the form of decorative, multi-layered laminates, particle board, fibreboard, plywood boards, electrolaminates, may fail to exhibit the necessary dimensional accuracy, i.e., more particularly, the thicknesses throughout its width may differ, necessitating costly subsequent treatment of the laminates, such as grinding of the surface or the like. Obviously, the decisive factor in obtaining a dimensionally accurate finished product is to keep the spacing between the press belts in the reaction zone uniformly constant throughout. Since substantial reaction forces occur during the pressing procedure, possibly impairing uniform spacing between the press belts, one endeavours to impart to the machine frame of the presses in question an extremely rigid design. In many cases, however, the quality of the finished product still leaves much to be desired.

It has been found that the insufficient dimensional accuracy of the laminates is substantially due to deformations in the press frame caused by the latter exhibiting different temperatures area-wise as a result of uncontrollable losses of heat, which may alter the geometry of the frame, thereby impairing the dimensional accuracy of the laminates.

The object underlying the invention is to improve a generic press in such a way that during operation the geometrical machine dimensions to not undergo alteration due to losses of heat.

The object is attained in accordance with the invention in that the press frame or at least parts of it are additionally heated by a further heating device, and thermal shield caps which may be moved out of the way are arranged on the press frame.

This enables losses of heat to be practically completely eliminated, and the press frame to be kept at a precisely constant temperature, so that ultimately a dimensionally accurate finished product is obtained.

With reference to the appended schematic drawings, the following description of a preferred embodiment serves to explain the invention in greater detail.

Figure 1:
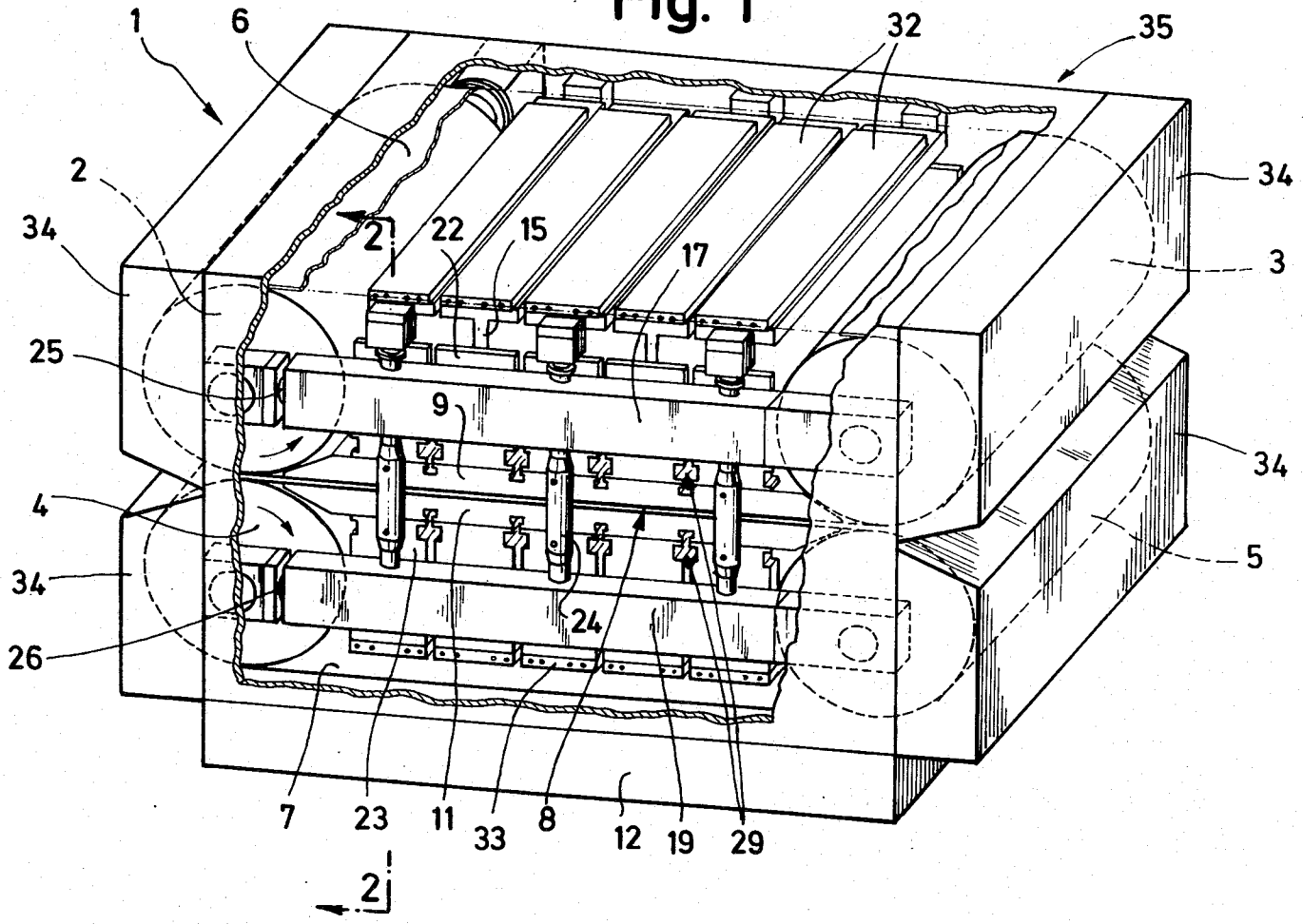
FIG. 1 shows a perspective general view of a continuously operating press.

In the continuously operating press, illustrated schematically in the Figures, for pressing an advancing web of material, four deflection rollers 2, 3, 4, 5 are rotatably mounted on a press frame 1. An endless upper press belt 6 extends around the rollers 2, 3 forming a first pair, and a lower press belt 7 around the rollers 4, 5 forming a further pair. The direction of rotation is indicated by the arrows in the deflection rollers 2, 4. Located between the lower strand of the upper press belt 6 and the upper strand of the lower press belt 7 is a press or reaction zone 8 in which a web of material advancing from left to right in FIG. 1, with the simultaneous application of heat, is compacted. Laminates impregnated with synthetic resin, particle board, fibreboard, plywood, electrolaminates and the like are particularly well suited as materials. The deflection rollers 2, 4 located at the intake side of the web of material are heated by appropriate heating devices in a manner known per se, for example, by a heated thermo-oil. The pressure to be exerted on the web of material (not illustrated) is transferred hydraulically or mechanically by pressure plates 9, 11 to the belt strands delimiting the reaction zone 8 at the top and bottom. If the pressure is transferred hydraulically, the pressure plates 9, 11 are mounted stationarily on the frame. A pressure medium which may be put under pressure is introduced into the space between pressure plate and rear side of the associated belt strand. In the case of mechanical pressure transferral, rollers extending transversely over the width of the belt are arranged in the space between the pressure plates which, in this case, are slideably mounted, and the associated belt strand. The pressure plates with the rollers may be pressed against the respective band strand via pressure medium cylinders mounted on the press frame. The pressure plates are heatable by heating devices associated with them, for example, by thermo-oil circulating in the plates. The press belts 6, 7 consist of metal, preferably stainless steel.

Figure 2:
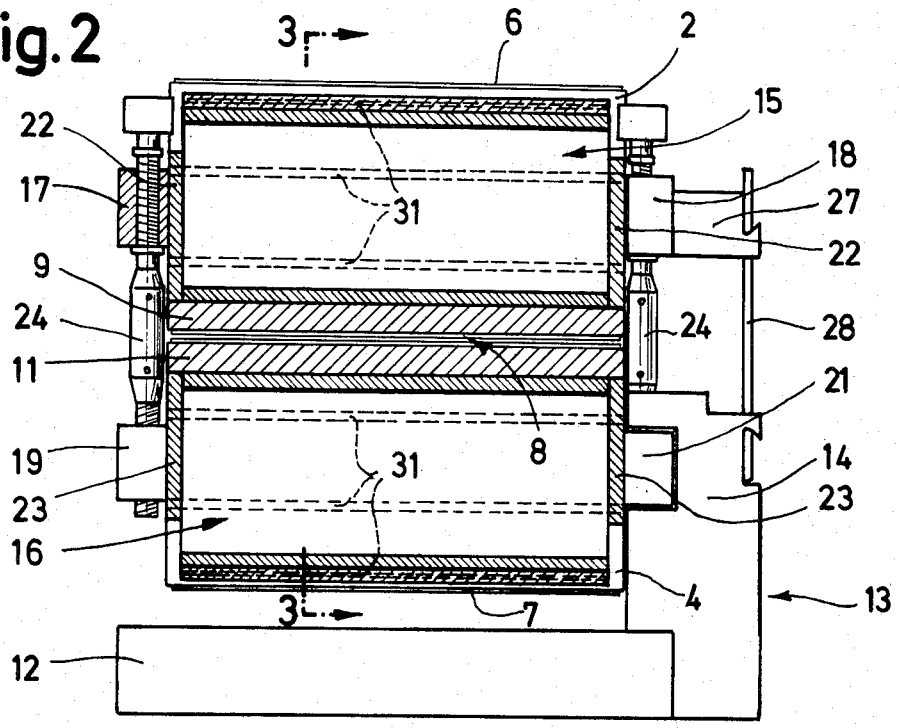
FIG. 2 shows a sectional view taken along the line 2—2 in FIG. 1.

The press frame, vide, in particular, FIGS. 1 and 2, encompass a stationary bottom plate 12 in which two L-shaped uprights 13 are firmly anchored. The deflection rollers 2, 3, 4, 5 are cantilevered on the vertically extending legs 14 of the uprights 13. This bearing arrangement includes as altogether cantilevered frame parts several supports 15, 16 in the form of strong, in themselves rigid double-T-supports and bearing bridges 17, 18, 19, 21 of substantially rectangular cross-section. The press belts 6, 7 extend around the supports and the bearing bridges. Welded to the front and rear end faces of the supports 15, 16 are elongate end plates 22, 23 to which the above-mentioned bearing bridges are screwed. The bearing bridges 17, 19 and 18, 21 are connected to each other by height-adjustable spindles 24 serving to adjust the height of the reaction zone 8 between the press belts 6, 7. The press belts 6, 7 are tensionable by hydraulic cylinders 25, 26 arranged in the bearing bridges 17 and 19 (FIG. 1) so that they are sure to be carried along by the driven deflection rollers.

As is apparent from FIG. 2, the right-hand, lower bearing bridge 21 is anchored in the leg 14 of the upright 13 in such a way that it supports in a cantilever manner the lower pair of rollers with the frame parts located therebetween, namely the supports 16 and the end plates 23, with the deflection rollers being rotatably mounted in the bearing bridges. The upper pair of deflection rollers (deflection rollers 2, 3) is supported at its bearing bridges 17, 18 via the spindles 24 on the bearing bridges 19, 21 of the lower pair of deflection rollers. Protruding from the right-hand bearing bridge 18 in FIG. 2 are arms 27 which are connected under tension with the leg 14 of the upright 13 by a tensile connecting rod 28 so as to produce an altogether stable, cantilever arrangement which—after removal of the spindles 24 visible in FIG. 1 at the front side of the press—enables exchange of the press belts 6, 7 and the pressure plates 9, 11. For this purpose, the pressure plates 9, 11 are connected under tension to the respective adjacent webs of the supports 15, 16 via groove-spring connections 29 known per se.

The reaction forces originating from the pressed web of material are conveyed via the pressure plates 9, 11 to the supports 15, 16 from where they are conveyed into the bearing bridges 17, 18, 19, 21 and subsequently via the spindles 24 and the uprights 13 into the bottom plate 12 and are thus absorbed by the ground.

Figure 3:
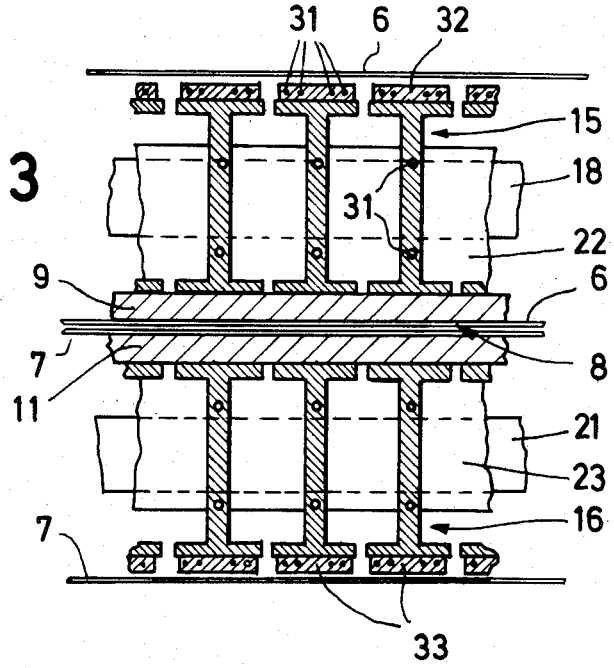
FIG. 3 shows a sectional view taken along the line 3—3 in FIG. 2.

In order to avoid losses of heat in the reaction zone 8, the pressure plates 9, 11 are preferably heated to the same temperature as the press belts 6, 7. As explained and illustrated, the pressure plates 9, 11 are in direct thermal contact with the rest of the press frame which is at least partially at room temperature since it is in contact with the ambient air. Temperature differences therefore occur in the press frame. On account of the high thermal longitudinal expansion coefficient of metals, those parts of the press frame at a high temperature will expand to a much higher degree than the other less strongly heated parts located further away from the pressure plates 9, 11. Owing to these different longitudinal expansions, deformations and saggings may occur in the press frame or in parts of it, particularly in the supports 15, 16, which causes the geometry of the press frame to deviate strongly from the ideal or desired shape to be maintained. This adversely affects the dimensional accuracy of the laminates leaving the press. In order to eliminate these disadvantageous temperature differences and the resulting deformations in the press frame, the press frame, in accordance with the invention, is heatable and has thermal shields. To this end, further heating devices are arranged on the press frame or at least on parts of its. These heating devices may, for example, be in the form of bores or channels 31 in the supports 15, 16 and end plates 22, 23. The bores form a conduction system through which a hot thermo-oil circulates. In another preferred embodiment of the invention, heating plates 32 and 33 (FIG. 3) by means of which the supports are brought to a desired temperature, preferably to the temperature of the pressure plates 9, 11, are directly connected to the upper and lower webs of the supports 15 and 16. There is therefore no longer any temperature difference between the supports 15, 16 and the reaction zone 8, and the supports do not sag. The heating plates 32, 33 may, themselves, likewise be heated, for example, with thermo-oil or electrically. They are preferably directly welded over a large contact surface to the supports 15, 16. Since, as is apparent from FIGS. 1 and 2, the end faces of the heating plates 32, 33 are easily accessible, lines for a thermo-oil circulation can be readily connected there.

Figure 4:
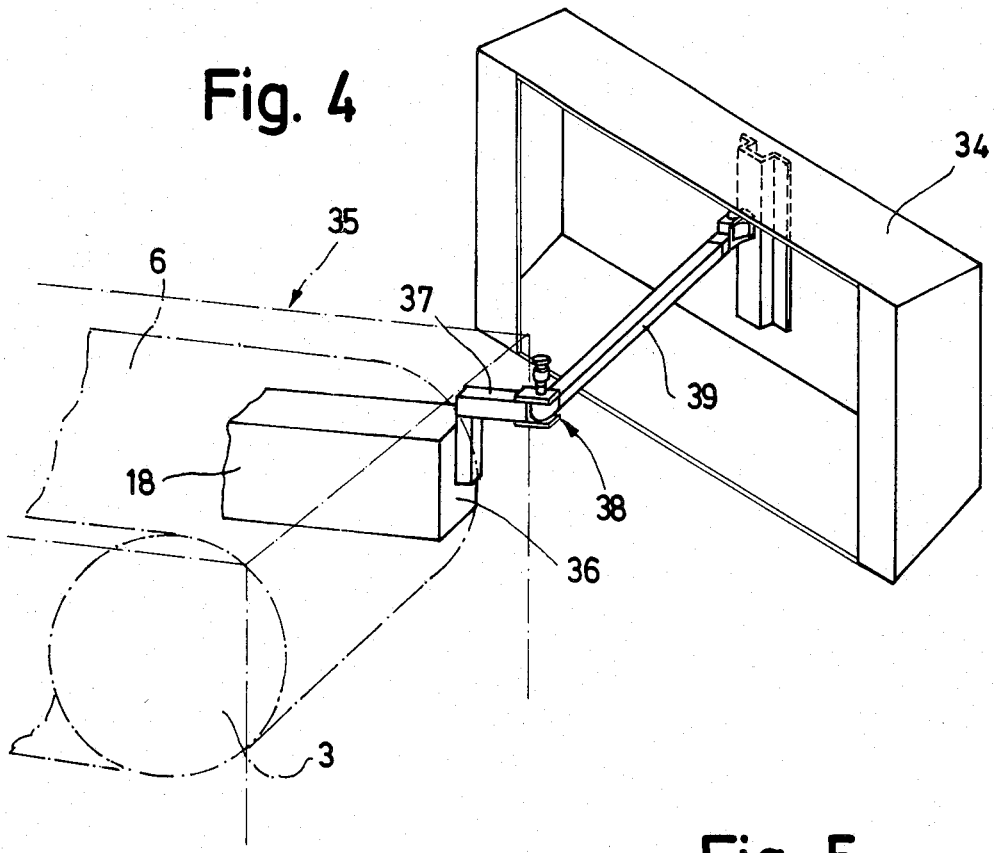
FIG. 4 shows a thermal shield cap in the open state.
Figure 5:
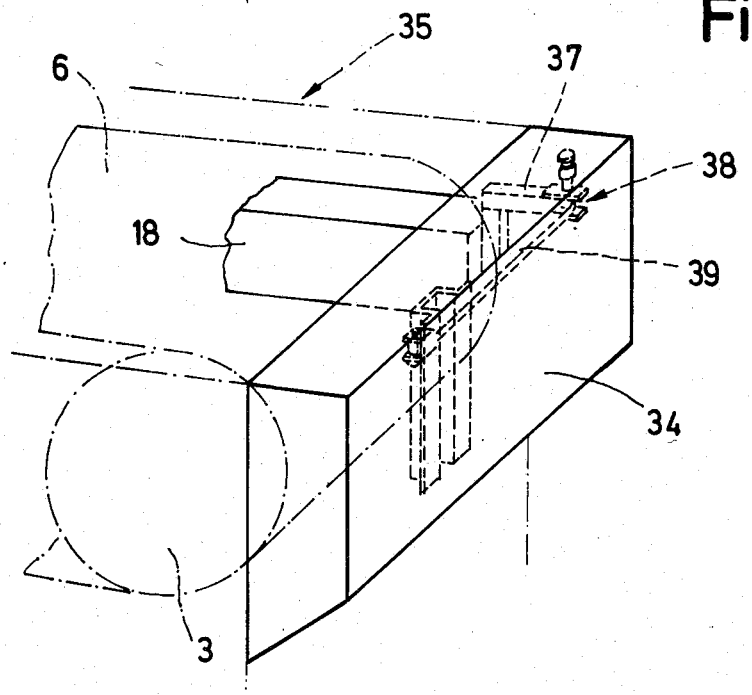
FIG. 5 shows the thermal shield cap of FIG. 4 in the closed state.

In order to further insulate the press frame and the press belts from the ambient air and to prevent losses of heat to the environment, there are arranged in the area of the cylindrical surfaces of the deflection rollers 2, 3, 4, 5 protruding from the end sides of the press frame 1, thermal shield caps 34 which form part of a machine casing 35 (FIG. 1) encompassing the press as a whole. Owing to this casing 34, 35, practically only the intake slit and outlet slit for the web of material to be pressed are in direct contact with the environment. The shield caps 34 which like the casing 35 are made of sheet metal are provided with a thermal insulating layer on the inside in a manner known per se. It is important to arrange this thermal shield cap on the press frame or the machine casing 35 in such a way that it can be easily moved out of the way since the press belts in the area of the deflection rollers occasionally need to have adhering residues of the web of material or resin emerging from it removed from them. Accordingly, in the embodiment shown in FIGS. 4 and 5, the thermal shield cap 34 is mounted in a laterally swivable manner so as to be easy to move out of the way by a single machine attendant. As illustrated, there is welded to the end face 36 of a bearing bridge 18 (or in another embodiment also on the machine casing 35) a bracket 37 in which an extension arm 39 is hinged for rotational movement by a hinge 38. By means of an axis, the shield cap 34 itself is mounted for rotation at the free end of the extension arm 39. Owing to this double joint construction, the shield cap 34 may be laterally swivelled towards the press where it requires relatively little space. In another embodiment, the shield cap may also be designed for swivel motion in an upward or downward direction. Displacement by means of telescopic arms or the like is also possible. Finally, in a further development of the movable shield cap, it may also be moved in a motor-driven manner known per se.

In particularly advantageous embodiments of the invention, the heating devices associated with the press frame or parts of it, for example, the heating plates 32, 33 or the temperature of a thermo-oil flowing through certain parts of the press, are controlled by regulating circuits known per se. Accordingly, in a first embodiment, the actual value of the sagging of the supports 15, 16 or other parts of the press frame is determined by measured value recorders and compared with the desired value which is to be met. If necessary, the heating of the press frame is then turned on and off from time to time, so that the desired value associated with the geometry of the press frame is constantly maintained. In another embodiment, the actual value of the laminate thickness may also be determined by appropriate sensor means, and the heating device of the press frame or its parts controlled via a regulating circuit which responds to deviations of this actual thickness of the finished laminate from the desired thickness.

Since such regulating circuits are known per se, the mechanical and electrical details of their design require no further explanation at this point.

Two different types of further heating devices for the press frame or parts of it have been described hereinabove, namely a heating by means of thermo-oil or by means of the heating plates 32, 33. These two types of heating may, of course, also be combined with one another. The various types of regulation may also be combined, for example, a regulating circuit responding to the sagging of the press frame and controlling the heating device of the press frame may be combined with a regulating circuit responding to the thickness of the finished laminate.

What is claimed is:

1. Continuously operating press for pressing an advancing web of material, comprising a rigid press frame, an upper and a lower endless press belt, each guided over a pair of deflection rollers mounted for rotation on the press frame, comprising a heating device to heat at least one deflection roller of each pair, comprising a reaction zone located between the upper and lower press belt strands facing each other for pressing the advancing web of material with the simultaneous application of heat, and comprising pressure plates with a heating device at the rear sides of the press belt strands remote from the reaction zone for exerting a pressure on these rear sides and, consequently, on the web of material, characterized in that, at least a portion of the press frame (1) are additionally heated by a further heating device (32, 33), and thermal shield caps (34) which may be moved out of the way are arranged on the press frame, said further heating device being controlled via a regulating circuit which responds to deviations of the actual geometry of the press frame from the desired geometry.

2. Press according to claim 1, characterized in that the thermal shield caps (34) are movable by a drive motor.

3. Press according to claim 1, characterized in that the sagging at least of one support (15, 16) of the press frame (1) acts as determining value for the deviation of the actual press geometry from the desired geometry.

4. Press according to claim 3, characterized in that the supports (15, 16) are heated by the further heating device (31; 32, 33).

5. Press according to claim 1, characterized in that the press frame (1) or parts (15, 16) of it are heatable at least to the same temperature as the press belts (6, 7).

6. Press according to claim 5, characterized in that circulation lines (31) for a thermo-liquid are provided as said further heating device.

7. Press according to claim 5, characterized in that additional heating plates (32, 33) are arranged as said further heating device.

8. Press according to one of claim 5, characterized in that the thermal shield caps (34) are swivably mounted on the press frame (1).

9. Press according to claim 5, characterized in that the thermal shield caps (34) are movable by a drive motor.

10. Press according to claim 1, characterized in that circulation lines (31) for a thermo-liquid are provided as said further heating device.

11. Press according to claim 10, characterized in that additional heating plates (32, 33) are arranged as said further heating device.

12. Press according to one of claim 10, characterized in that the thermal shield caps (34) are swivably mounted on the press frame (1).

13. Press according to claim 10, characterized in that the thermal shield caps (34) are movable by a drive motor.

14. Press according to claim 1 characterized in that additional heating plates (32, 33) are arranged as said further heating device.

15. Press according to one of claim 14, characterized in that the thermal shield caps (34) are swivably mounted on the press frame (1).

16. Press according to claim 14, characterized in that the thermal shield caps (34) are movable by a drive motor.

17. Press according to one of claim 1, characterized in that the thermal shield caps (34) are swivably mounted on the press frame (1).

18. Press according to claim 17, characterized in that the thermal shield caps (34) are movable by a drive motor.

19. Continuously operating press for pressing an advancing web of material, comprising a rigid press frame, an upper and a lower endless press belt, each guided over a pair of deflection rollers mounted for rotation on the press frame, comprising a heating device to heat at least one deflection roller of each pair, comprising a reaction zone located between the upper and lower press belt strands facing each other for pressing the advancing web of material with the simultaneous application of heat, and comprising pressure plates with a heating device at the rear sides of the press belt strands remote from the reaction zone for exerting a pressure on these rear sides and, consequently, on the web of material, characterized in that, at least a portion of the press frame (1) is additionally heated by a further heating device (32, 33), and thermal shield caps (34) which may be moved out of the way are arranged on the press frame, said further heating device being controlled via a regulating circuit which responds to deviations of the actual thickness of the finished laminate from its desired thickness.

20. Press according to claim 19, characterized in that the press frame (1) or parts (15, 16) of it are heatable at least to the same temperature as the press belts (6, 7).

21. Press according to claim 20, characterized in that circulation lines (31) for a thermo-liquid are provided as said further heating device.

22. Press according to claim 20, characterized in that additional heating plates (32, 33) are arranged as said further heating device.

23. Press according to claim 20, characterized in that the thermal shield caps (34) are swivably mounted on the press frame (1).

24. Press according to claim 20, characterized in that the thermal shield caps (34) are movable by a drive motor.

25. Press according to claim 19, characterized in that circulation lines (31) for a thermo-liquid are provided as said further heating device.

26. Press according to claim 25, characterized in that additional heating plates (32, 33) are arranged as said further heating device.

27. Press according to claim 25, characterized in that the thermal shield caps (34) are swivably mounted on the press frame (1).

28. Press according to claim 25, characterized in that the thermal shield caps (34) are movable by a drive motor.

29. Press according to claim 19, characterized in that additional heating plates (32, 33) are arranged as said further heating device.

30. Press according to claim 29, characterized in that the thermal shield caps (34) are swivably mounted on the press frame (1).

31. Press according to claim 29, characterized in that the thermal shield caps (34) are movable by a drive motor.

32. Press according to claim 19, characterized in that the thermal shield caps (34) are swivably mounted on the press frame (1).

33. Press according to claim 32, characterized in that the thermal shield caps (34) are movable by a drive motor.

34. Press according to claim 19, characterized in that the thermal shield caps (34) are movable by a drive motor.

* * * * *